US005378675A

United States Patent [19]

Takeyama et al.

[11] Patent Number: 5,378,675

[45] Date of Patent: Jan. 3, 1995

[54] THERMAL TRANSFER RECORDING IMAGE RECEIVING SHEET

[75] Inventors: Toshihisa Takeyama; Shigehiro Kitamura; Kunihiro Koshizuka, all of Hino, Japan

[73] Assignee: Konica Corporation, Tokyo, Japan

[21] Appl. No.: 982,833

[22] Filed: Nov. 30, 1992

Related U.S. Application Data

[63] Continuation-in-part of Ser. No. 964,942, Oct. 22, 1992, abandoned.

[30] Foreign Application Priority Data

Nov. 5, 1991 [JP] Japan ..... 3-288721

[51] Int. Cl.[6] ..... B41M 5/035; B41M 5/38

[52] U.S. Cl. ..... 503/227; 428/195; 428/206; 428/318.4; 428/480; 428/483; 428/500; 428/513; 428/523; 428/913; 428/914

[58] Field of Search ..... 8/471; 428/195, 206, 428/480, 483, 500, 523, 913, 914, 513; 503/227

[56] References Cited

U.S. PATENT DOCUMENTS

| | | | |
|---|---|---|---|
| 4,774,224 | 9/1988 | Campbell | 503/227 |
| 4,837,200 | 6/1989 | Kondo et al. | 503/227 |
| 4,987,049 | 1/1991 | Komamura et al. | 430/203 |
| 4,999,335 | 3/1991 | Mruk et al. | 503/227 |

FOREIGN PATENT DOCUMENTS

| | | | |
|---|---|---|---|
| 0410724 | 1/1991 | European Pat. Off. | 428/195 |
| 61-186471 | 11/1986 | Japan | 503/227 |
| 61-186473 | 11/1986 | Japan | 503/227 |
| 63-87286 | 4/1988 | Japan | 503/227 |

OTHER PUBLICATIONS

Database WPIL, No. 90-0866334, Derwent Publications Ltd., London, GB; & JP-A-2038089 (OJI Paper) Jul. 2, 1990 *The entire abstract*.

*Primary Examiner*—B. Hamilton Hess

*Attorney, Agent, or Firm*—Frishauf, Holtz, Goodman & Woodward

[57] ABSTRACT

A thermal transfer recording image receiving sheet which are free from printing unevenness, high in sensitivity and transfer density, and immune from curling is disclosed. The sheet is laminated on a support with a polypropylene layer of 5 to 100 μm in thickness, containing fine white hollow particles.

13 Claims, 1 Drawing Sheet

THERMAL TRANSFER RECORDING IMAGE RECEIVING SHEET

This application is a continuation-in-part application of Ser. No. 07/964,942 filed Oct. 22, 1992, now abandoned.

FIELD OF THE INVENTION

This invention relates to a thermal transfer recording image receiving sheet and a method for producing it. More specifically, this invention relates to a thermal transfer recording image receiving sheet and a method for producing it, which cause neither uneven images nor curls at the time of image formation and are capable of forming images in a high sensitivity and a high transfer density.

BACKGROUND OF THE INVENTION

As methods for obtaining colored hard copies, there have so far been studied color recording techniques such as ink jet recording, electrophotography and thermal transfer recording. Of these methods, thermal transfer recording has, not necessarily limited to the case of color recording, advantages that it is easy to handle and maintain, allows downsizing of apparatus and requires less cost.

This thermal transfer recording includes the heat melt transfer method and the thermo-diffusion transfer method; the latter is also called the thermo-sublimation transfer method, because it uses a sublimation-type thermal transfer recording ink sheet having on a support an ink layer containing a sublimation dye which sublimates on heating and transfers, through diffusion, onto a thermal transfer recording image receiving sheet.

This thermo-diffusion transfer method can control the gradation of an image by varying the amount of dye to be transferred correspondingly to the change in the amount of heat energy applied by a thermal head. Accordingly, it has a distinctive advantage that it can easily form multicolor printed images having a continuous change in color shades by performing a superposition-recording using the three primary colors of cyan, magenta and yellow.

With such an advantage, the thermal transfer recording method of thermo-diffusion transfer type has come to be extensively used in making image recording bodies to record gradational color images such as color photographic images.

However, conventional thermal transfer recording image receiving sheets used in this thermal transfer recording method have problems of causing uneven printing owing to surface irregularities or adhesion of foreign matter and yielding a low transfer sensitivity and an insufficient transfer density.

As a measure to solve these problems, use of a support of porous structure is proposed as described in Japanese Pat. O.P.I. Pub. Nos. 112693/1986, 148293/1987, 152793/1987, 1595/1988, 231984/1988, 44781/1989, 47536/1989, 168493/1989, 92592/1990, etc.

Further, methods for laminating a porous intermediate layer between the support and the image receiving layer are proposed as seen in Japanese Pat. O.P.I. Pub. Nos. 270192/1986, 87286/1988, 122593/1988, 145192/1989, 280586/1989, 89690/1990, 241740/1990, 76687/1991, etc. and methods for laminating an intermediate layer having a cushioning function between the support and the image receiving sheet are proposed as seen in Japanese Pat. O.P.I. Pub. Nos. 144394/1986, 258793/1986, 146693/1987, 151393/1987, 5885/1989, 26497/1989, etc.

In these methods, however, the unevenness in images, though fairly reduced, cannot be prevented enough at all times; moreover, a sufficient transfer density and a sufficient transfer sensitivity cannot be obtained in times; in the case of intermediate layers having a porous structure, curling cannot be prevented enough on occasion for their insufficient heat stability and dimensional stability. Further, when an intermediate layer is formed by a coating method, curling tends to occur in the drying process after coating because of the thermal shrinkage of the coated layer, besides an environmental problem which may be caused by evaporation of solvents.

In order to prevent such disadvantages, there is proposed extrusion lamination of a polyolefine resin on a base made of wood pulp or natural pulp as described in Japanese Pat. O.P.I. Pub. Nos. 263081/1989, 106397/1990, 305688/1990 and U.S. Pat. Nos. 4,774,224, 4,999,335. When paper is used as a base, curling can be prevented, but there occur at times uneven images attributable to the surface waviness of fibers in the paper as well as insufficient transfer sensitivities and transfer densities due to diffusion of heat during recording.

SUMMARY OF THE INVENTION

The present invention is made to improve the above situation.

Accordingly, the object of the present invention is to provide a thermal transfer recording image receiving sheet and a method for producing it, which are capable of forming images free from unevenness, high in sensitivity and transfer density and immune from curling.

The present inventors have found that the above object is attained by laminating a resin composition containing polypropylene as principal component by melt extrusion, or by providing an intermediate layer having a porous structure, on a base having a resin layer at least on one side which constitutes a support of a thermal transfer recording image receiving sheet.

As a result of a further study, the inventors have found that among the above laminating layers comprising polypropylene as principal component, a laminating layer having a specific thickness is more effective, that addition of a specific additive to this laminating layer is much more effective, and that appropriate contrivances on the base composition and laminated position of a subbing layer can produce favorable results.

The above object can also be attained by forming, as a support of a thermal transfer recording image receiving sheet, a porous intermediate layer at least on one side of a base having resin layers on both sides directly or via a barrier layer.

The present invention has been accomplished on the basis of these findings itemized as follows:

A1. A thermal transfer recording image receiving sheet which has a support made of a resin or a support made of a basic material with the first resin layer on its surface, and superposed thereon, a 5- to 100-μm thick layer which contains polypropylene as a principal component is laminated on the support made of a resin or the first resin layer, directly or via the first subbing layer.

An image receiving layer having dyeability to a thermodiffusible dye, is superposed on the laminated layer directly or via the second subbing layer.

A2. The first subbing layer and/or the second subbing layer contains at least one of the resins of alkyl titanates, titanium-modified water-borne resins, ethylene-vinyl acetate copolymers, acrylic resins, urethane resins, polyester resins or epoxy resins.

A3. The laminated layer contains white fine particles.

A4. The white fine particles are hollow fine particles.

A5. On the opposite side of the support to the image receiving layer, the second resin layer is coated directly or via the third subbing layer.

A6. The second resin layer contains polyolefine as a principal component and has a thickness of 5 to 100 μm.

A7. The third subbing layer preferably contains, as a principal component, at least one of the resins of alkyl titanates, titanium-modified water-borne resins, ethylenevinyl acetate copolymers, acrylic resins, urethane resins, polyester resins or epoxy resins.

A8. The support, or the first resin layer of column A1, contains polyethylene terephthalate as a principal component.

A9. Another embodiment of the thermal transfer recording image receiving sheet is that the support is composed of a base having the third resin layer on one side and the second resin layer on the other side, and an intermediate layer is laminated on the third resin layer of the support. The intermediate layer has a porous structure, and an image receiving layer having dyeability to a thermo-diffusible eye, is superposed on the intermediate layer directly or via a barrier layer.

A10. The intermediate layer of A9, may contain a liquid material insoluble in a coating solvent at a temperature at which the intermediate layer is coated.

A11. The base of column A9 can be a paper.

A12. The second resin layer of A9 contains polyolefine as principal component.

A13. The third resin layer and/or the second resin layer of A12. contains white fine particles.

A14. In a method of producing the thermal transfer recording image receiving sheet, laminating polypropylene of a thickness of 5 to 100 μm, is made by the melt extrusion method, on the surface of the support or a support composed of a base having a first resin layer on one side, directly or after forming a first subbing layer by coating and/or lamination, and then an image receiving layer having dyeability to a thermo-diffusible dye is laminated on this laminating layer, directly or after forming a second subbing layer by coating and/or laminating.

A15. In the method of A14, the support is formed providing a second resin layer through lamination of a resin, directly or via a third subbing layer, on one side of the support opposite to the side on which the image receiving layer is formed.

A16. In the method of A15, the second resin layer is formed to a thickness of 5 to 100 μm using a resin of which the principal component is polyolefine.

A17. In a method of producing the thermal transfer recording image receiving sheet, the intermediate layer having a porous structure is formed on the third resin layer on one side and a second resin layer on the other side, directly or after subjecting the third layer to a surface treatment, and then the image receiving layer having dyeability to a thermodiffusible dye is formed on the intermediate layer, directly or after forming a barrier layer.

A18. In the method of A17, the intermediate layer is formed by coating on the third resin layer of the support, in which a coating solution contains a solvent in which a resin is dissolved. The coated material is dipped into a liquid which does not dissolve the third resin layer but dissolves the solvent.

A19. A method for producing the thermal transfer recording image receiving sheet as stated in A18, in which the third resin layer and/or the second resin layer is formed on the surface of the base by melt extrusion.

BRIEF DESCRIPTION OF THE DRAWING

FIG. 1

Figure 1:
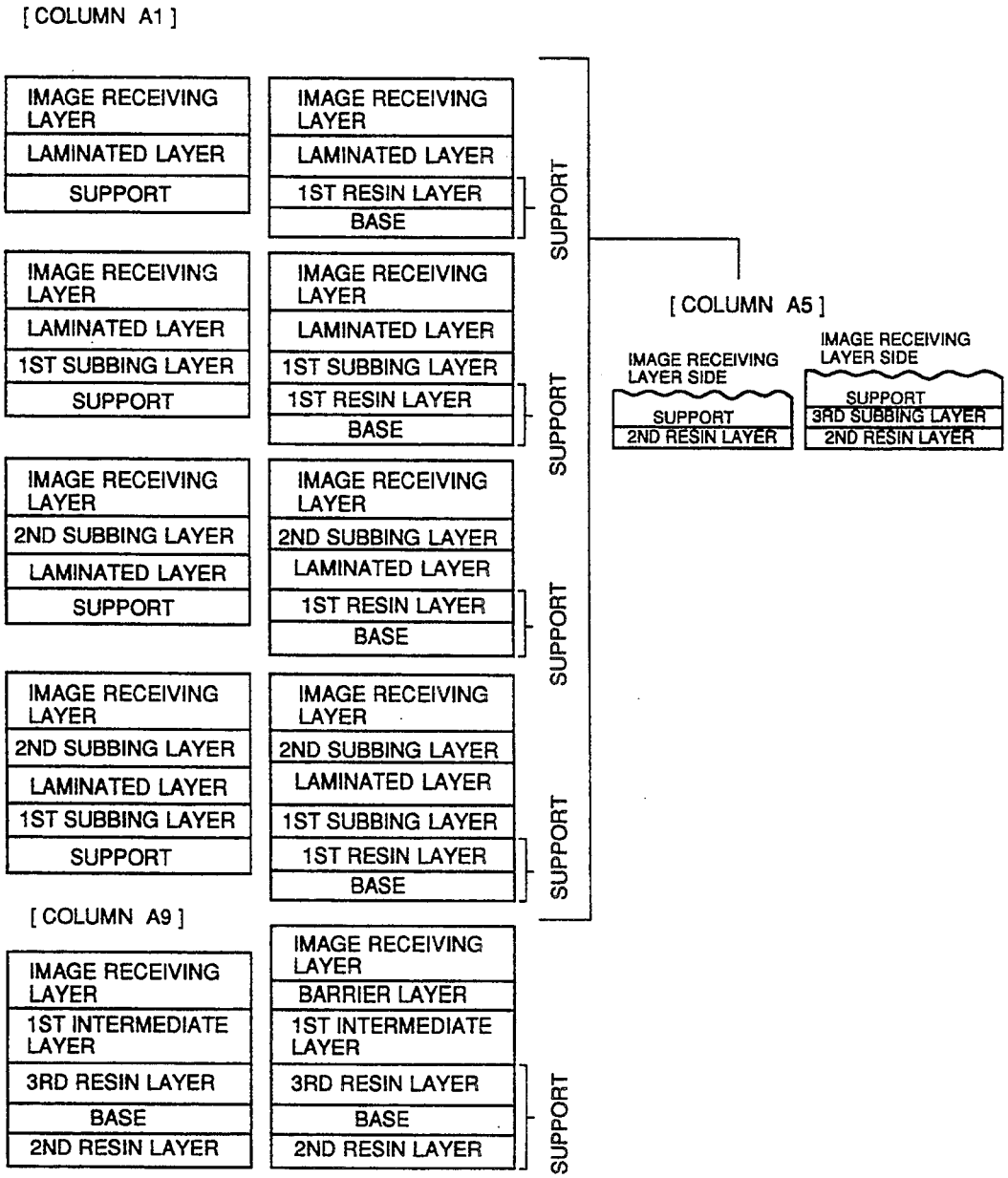
FIG. 1 is a schematic diagram to show the construction of the invention.

1 Column A1
2 Image receiving Layer
3 Laminating Layer
4 Support (resin)
4' Base
5 Support
6 1st Subbing Layer
7 1st Resin Layer
8 2nd Subbing Layer
9 Column A5
10 Image Receiving Layer Side
11 2nd Resin Layer
12 3rd Subbing Layer
13 Column A9
14 Porous Intermediate Layer
15 3rd Resin Layer The invention includes, as shown in the schematic diagram of FIG. 1, a thermal transfer recording image receiving sheet having a support formed of a resin or a support composed of a base having a first resin layer on the surface, a 5- to 100-μm thick laminating layer, of which principal component is polypropylene, laminated on said first resin layer directly or via a first subbing layer, and an image receiving layer having a dyeability to a thermo-diffusible dye and laminated on said laminating layer directly or via a second subbing layer.

The invention stated in column A2 includes the thermal transfer recording image receiving sheet stated in column A1 wherein said first subbing layer and/or said second subbing layer comprises, as principal component, at least one of the resins selected from alkyl titanates, titanium-modified water-borne resins, ethylene-vinyl acetate copolymers, acrylic resins, urethane resins, polyester resins and epoxy resins.

The invention stated in column A3 includes the thermal transfer recording image receiving sheet stated in column A1 or A2 wherein said laminating layer contains white fine particles.

The invention stated in column A4 includes the thermal transfer recording image receiving sheet stated in column A3 wherein said white fine particles are hollow fine particles.

The invention stated in column A5 includes, as shown in the schematic diagram of FIG. 1, the thermal transfer recording image receiving sheet stated in any of column A1 to A4 wherein said second resin layer is laminated directly or via a third subbing layer on the surface of said support oppositely with the image receiving layer.

The invention stated in column A6 includes the thermal transfer recording image receiving sheet stated in column A5 wherein said second resin layer contains polyolefine as principal component and has a thickness of 5 to 100 μm.

The invention stated in column A7 includes the thermal transfer recording image receiving sheet stated in column A5 wherein said third subbing layer comprises, as principal component, at least one of the resins selected from alkyl titanates, titanium-modified waterborne resins, ethylenevinyl acetate copolymers, acrylic resins, urethane resins, polyester resins and epoxy resins.

The invention stated in column A8 includes the thermal transfer recording image receiving sheet stated in column A1 wherein said support formed of a resin or said first resin layer comprises polyethylene terephthalate as principal component.

The invention stated in column A9 includes, as shown in the schematic diagram of FIG. 1, the thermal transfer recording image receiving sheet comprising a support composed of a base having a third resin layer on one side and a second resin layer on the other side, an intermediate layer having a porous structure and laminated on said third resin layer of said support, and an image receiving layer laminated on said intermediate layer directly or via a barrier layer and having a dyeability to a thermo-diffusible dye.

The invention stated in column A10 includes the thermal transfer recording image receiving sheet stated in column A9 wherein said intermediate layer contains a liquid material insoluble in a coating solvent at a temperature to coat said intermediate layer.

The invention stated in column All includes the thermal transfer recording image receiving sheet stated in column A9 wherein said base is formed of paper.

The invention stated in column A12 includes the thermal transfer recording image receiving sheet stated in column A9 wherein said third resin layer and/or said second resin layer comprises polyolefine as principal component.

The invention stated in column A13 includes the thermal transfer recording image receiving sheet stated in column A12 wherein said third resin layer and/or said second resin layer contains white fine particles.

The invention stated in column A14 includes the method for producing a thermal transfer recording image receiving sheet which comprises the steps of forming a laminating layer by coating a resin composition comprising polypropylene as principal component to a thickness of 5 to 100 μm through melt extrusion on the surface of a support formed of a resin, or on a first resin layer of a support having said first resin layer on one side, directly or after forming a first subbing layer by lamination and/or coating, and then forming an image receiving layer having a dyeability to a thermo-diffusible dye on this laminating layer, directly, or after forming a second subbing layer by coating and/or lamination.

The invention stated in column A15 includes the method for producing a thermal transfer recording image receiving sheet stated in column A14 wherein said support is formed by providing a second resin layer, through lamination of a resin, directly or via a third subbing layer, on the surface of said support oppositely with the side on which the image receiving layer is to be formed.

The invention stated in column A16 includes the method for producing a thermal transfer recording image receiving sheet stated in claim 15 wherein said second resin layer is formed to a thickness of 5 to 100 μm by use of a composition comprising polyolefine as principal component.

The invention stated in column A17 includes the method for producing a thermal transfer recording image receiving sheet which comprises the steps of forming an intermediate layer having a porous structure, on a third resin layer of a support composed of a base having said third resin layer on one side and the second resin layer on the other side, directly or after the surface treatment of said third resin layer, and forming an image receiving layer having a dyeability to a thermo-diffusible dye, on said intermediate layer directly or after providing a barrier layer.

The invention stated in column A18 includes the method for producing a thermal transfer recording image receiving sheet stated in column A17 wherein said intermediate layer is formed by coating a coating solution dissolving a resin in a solvent on a first resin layer of said support, and then dipping the coated material into a liquid incapable of dissolving said third resin layer but capable of dissolving said solvent.

The invention stated in column A19 includes the method for producing a thermal transfer recording image receiving sheet stated in column A18 wherein said third resin layer and/or said second resin layer is formed on the surface of the base by melt extrusion.

FIG. 1 is a schematic diagram as described above, and the detailed layered structure according to the invention will become apparent from the description to follow.

DETAILED DESCRIPTION OF THE INVENTION

The thermal transfer recording image receiving sheet and the method for the production thereof according to the invention are hereinafter described in detail.

(I) Thermal Transfer Recording Image Receiving Sheet and Method for Producing it (Part 1)

The thermal transfer recording image receiving sheet of claim 1 comprises a support formed of a resin or a support composed of a base having the first resin layer at least on one side, a laminating layer comprising polypropylene as principal component and laminated on the support in a thickness of 5 to 100 μm, and an image receiving layer laminated on the laminating layer and having a dyeability to a thermo-diffusible dye.

(I-a) Support

A support formed of a resin or a support composed of a base having the first resin layer at least on one side is used as the above support.

Examples of such a resin or those which form such a resin layer include acrylic resins derived from acrylates and methacrylates; polyester type resins such as polyethylene terephthalates, polybutylene terephthalates, polyethylene naphthalates, polycarbonates, polyarylates; polyolefine type resins such as polyvinyl chlorides, polyvinylidene chlorides, polyvinylidene fluorides, polyethylenes, polypropylenes, polystyrenes; polyamide type resins such as nylons, aromatic polyamides; polyether ether ketones; polysulfones, polyether sulfones, polyimides, polyether imides, polyparabanic acids, phenoxy resins, epoxy resins, urethane resins, melamine resins, alkyl resins, phenol resins, fluororesins and silicone resins.

In view of dimensional stability, it is preferable that the support formed of a resin or the first resin layer in the invention be a sheet or film each subjected to drawing and heat setting. Among the resins described above, favorable ones are polyester type resins such as polyethylene terephthalates, polybutylene terephthalates, polyethylene naphthalates, polycarbonates and polyarylates. And polyethylene terephthalates, polybutylene terephthalates and polyethylene naphthalates, particularly, polyethylene terephthalates are preferred in respect of costs and formability into sheets or film. Further, the support formed of a resin or the first resin layer can be properly selected according to uses from those having no micro-voids and those having micro-voids.

Examples of the support having the first resin layer include plastic films or sheets laminated with two or more of such resin layers; and films or sheets of various high-molecular materials, metals, ceramics and papers made of wood pulp, cellulose pulp or sulfite pulp, which are laminated with the above resin layer.

When the support is employed in uses which require transparency, such as transparent originals for an overhead projector and seals to be put on glass, one having a high transparency is preferred. In the case of reflection images, there may be incorporated in a component layer of the support a white pigment, such as titanium oxide, zinc oxide, silicia, barium sulfate, magnesium carbonate, calcium carbonate, talc or clay, for enhancing the sharpness of images formed.

The thickness of the support is appropriately selected within a range of usually 20 to 1,000 μm, preferably 50 to 500 μm.

In the invention, for the purposes of preventing curling and improving texture, the second resin layer may be laminated, directly or via a subbing layer described below (hereinafter occasionally referred to as the third subbing layer), on the support oppositely with the image receiving layer.

The composition of this second resin layer may be the same as, or different from, that of the laminating layer provided on the side of the image receiving layer described later.

The resin to form the second resin layer may be any resin as long as it is less in necking-in and good in drawdown property. Examples thereof include olefine type resins such as high density polyethylenes, medium density polyethylenes, low density polyethylenes, polypropylenes, polybutenes, polypentenes, polystyrenes, ethylene-vinyl acetate copolymers; polyester resins such as polyethylene terephthalates; ionomer resins; nylons and polyurethanes.

Among them, polyolefine type resins are preferred. Particularly, high density polyethylenes, medium density polyethylenes, low density polyethylenes, polypropylenes, polybutenes, polypentenes, ethylene-propylene copolymers are preferably used singly or in combination of two or more kinds.

When polyolefine type resins are used, the thickness of the resin layer is properly selected within a range of usually 5 to 100 μm, preferably 10 to 50 μm.

In the resin layer comprising polyolefine as principal component, there may be added an additive usable in the laminating layer formed on the same side as the image receiving layer described later.

The resin layer can be formed on the support in the same manner as the laminating layer and, if necessary, it may be subjected to calendering for a smooth surface or embossing for a matted surface.

(I-b) Laminating Layer

In the invention, the laminating layer having a specific thickness and comprising polypropylene as principal component is laminated at least on one side of the support. This laminating layer can be formed by melt extrusion (occasionally called the hot-melt extrusion laminating method).

As compared with polyolefine type resins used in the usual lamination, particularly with polyethylene, polypropylene is high in heat resistance and low in thermal conductivity; therefore, it has preferable capabilities of preventing curling and providing sufficient transfer sensitivities and transfer densities.

Further, it is preferable that the melt flow rate (test method: ASTM D1238) of this polypropylene be within a range of 0.5 to 15 g/10 min, especially within a range of 1 to 10 g/10 min. And, as long as its drawdown property is sufficient in it may be either a homopolymer or a copolymer, or may be a mixture of two or more kinds of polypropylenes.

The thickness of the laminating layer according to the invention can be properly selected within a range of usually 5 to 100 μm, preferably 10 to 50 μm.

When the thickness is less than 5 μm, cushioning characteristics are poor and uneven images become liable to occur; when the thickness is more than 100 μm, the cushioning characteristics are not improved any more, the balance in thickness between the support and the laminating layer gets worse and, moreover, curling may occur at the time of image formation.

Lamination by melt extrusion can be carried out by the usual methods described in Japanese Pat. O.P.I. Pub. Nos. 63081/1989, 271289/1989, 106397/1990, 111586/1990, 05688/1990, 49991/1991, etc.

For the purposes of raising the whiteness and enhancing the heat resistance of the laminating layer, it is preferred to add further white fine particles to the composition comprising polypropylene as principal component.

As the white fine particles described above, either inorganic fine particles or organic fine particles can be used as long as these are good in heat stability during lamination.

Examples of the inorganic fine particles include metal oxides such as silica, titanium oxide, aluminium oxide, zinc oxide, magnesium oxide, aluminium borate; metal salts such as calcium carbonate, magnesium carbonate, barium sulfate, magnesium sulfate, aluminium hydroxide, boron nitride; and kaolin, clay, talc, zinc white, white lead, quartz, diatomaceous silica, pearlite, bentonitc, mica and synthetic mica.

Examples of the organic fine particles include melamine resin particles, guanamine resin particles, styrene-acryl copolymer resin particles, silicone resin particles and fluororesin particles.

Among these white fine particles, hollow resin fine particles are preferred for their capabilities of raising the transfer sensitivity or transfer density; examples of such hollow fine particles include bridged styrene-acryl hollow resin particles.

When the above white fine particles are added, the content in the laminating layer is properly selected within a range of usually 1 to 30 wt %, preferably 5 to 20 wt %.

The average particle size of these white fine particles is usually 0.01 to 2 μm, preferably 0.02 to 1 μm.

Besides the above white fine particles, the laminating layer may contain additives such as antistatic agents, thermal stabilizer, antioxidants, UV absorbents, light stabilizers and optical whitening agents, which do not decompose at the laminating temperature.

The addition amount of these additives is selected to be usually not more than 30 wt %, preferably not more than 20 wt %.

In the invention, when the adhesion between the support and the laminating layer is not sufficient, it is preferable that the resin layer be subjected to a surface treatment prior to the lamination of a composition comprising polypropylene as principal component on the support.

This surface treatment can be performed by use of the conventional resin surface modification techniques such as the corona discharge treatment, flame treatment, ozone treatment, ultraviolet light treatment, irradiation treatment, roughening treatment, chemical treatment, low temperature plasma treatment and grafting treatment. Details to perform these treatments can be seen in Chapter 2 of "Kobunshi Hyomen No Kiso To Oyo, Ge (Fundamentals and Applications of Polymer Surfaces, Part 2)" by Kagaku Dojin Co., Chapter 8 of "Kobunshi Shinsozai Binran (Handbook of New Polymeric Materials)" by Maruzen Co., etc. These treatments may be carried out in combination of two or more kinds.

The support provided with the laminating layer in the above manner may be subjected to heat setting under the control of dimensions to improve the dimensional stability, or the laminating layer may be subjected to calendering or embossing when necessary.

(I-c) Image Receiving Layer

In the invention, an image receiving layer is formed on the laminating layer provided as above.

There is no particular restriction on this image receiving layer as long as the layer has a dyeability to a thermo-diffusible dye. According to uses, it can be formed of various materials, with various compositions and in various layer configurations. It may be formed similarly to an image receiving layer comprising a conventional material, composition and layer configuration, or a proper modification may be made on these matters.

Suitable resins for forming such an image receiving layer are, for example, polyvinyl chloride type resins, polyvinylidene chloride type resins, polystyrene type resins, polyester type resins, acrylic resins, epoxy resins, phenoxy resins, polyvinyl acetal type resins, cellulosic resins, polyvinyl pyrrolidones, polycarbonates, polysulfones, polyarylates, polyparabanic acids, polyurethane resins and polyamide resins.

These resins may be used singly or in combination of two or more kinds.

In forming the image receiving layer, the above resins may be cross-linked or hardened by means of irradiation, heat, moisture or catalysts which utilize reactive sites of these resins. In such a case, irradiation-curable monomers such as epoxides and acrylates and cross-linking agents such as isocyanates may be used.

Further, when dyes capable of chelating metal ions (capable of forming chelate dye images) are contained in the ink layer of a thermal transfer recording ink sheet as described later, metal-ion-containing compounds may be used in the image receiving layer if necessary.

Examples of such metal-ion-containing compounds include those exemplified in the specification of U.S. Pat. No. 4,987,049.

These metal-ion-containing compounds are added in an amount of preferably 5 to 60 wt %, especially 10 to 40 wt % of the total amount of the components used to form the image receiving layer.

The image receiving layer may contain, if necessary, additives such as releasants, antioxidants, heat stabilizers, UV absorbents, light stabilizers, fillers, pigments and optical whitening agents. Plasticizers or heat-fusible materials may also be contained as sensitizer.

In the invention, the total addition amount of additives is preferably selected within a range from 0.1 to 30 wt % of the resin to form the image receiving layer.

The thickness of the image receiving layer is within a range of usually 3 to 30 μm, preferably 5 to 20 μm.

The image receiving layer may be a single layer or, necessary, may have a multi-layered structure consisting of the same or different compositions. Further, the image receiving layer may be formed covering the whole laminating layer, or on its limited portions according to a specific requirement.

The image receiving layer can be formed by the coating method comprising the steps of preparing a coating solution to form the image receiving layer by dispersing or dissolving the necessary components in a solvent, then coating and drying the solution on the surface of a layer composed of a composition comprising polypropylene as principal component, or by the hot-melt extrusion laminating method comprising melt extrusion of a mixture of the components to form the image receiving layer.

Solvents usable in the coating method are, for example, water, alcohols, cellosolves, aromatic hydrocarbons, ketones, esters, ethers and chlorinated solvents.

In carrying out the coating, the conventional coating methods, such as engraved-roll coating, extrusion coating, wire bar coating and roll coating, can be employed.

A proper drying after the coating gives an image receiving layer with a prescribed dry coating thickness. When the adhesion between the image receiving layer and the laminating layer is not sufficient, it is preferable that the laminating layer be subjected to a surface treatment prior to the formation of the image receiving layer. This surface treatment is preferably carried out by use of the abovementioned method applied onto the support. Preferably, this surface treatment is carried out by the above method which is applied to the support; the procedure of the method can be employed without any modification.

(I-d) Subbing Layer

In the invention, it is preferable that a subbing layer be each formed between the support and the laminating layer, between the laminating layer and the image receiving layer, and between the support and the second resin layer. For the sake of convenient explanation, the subbing layer formed between the support and the laminating layer is hereinafter occasionally referred to as the first subbing layer, the subbing layer formed between the laminating layer and the image receiving layer is referred to as the second subbing layer, and the subbing layer formed between the support the second resin layer is referred to as the third subbing layer.

These subbing layer can be formed of at least one of resins selected from alkyl titanates, titanium-modified water-borne resins, ethylene-vinylacetate copolymers, acrylic resins, urethane resins, polyester resins and epoxy resins.

The thickness of the subbing layer is properly selected within a range of usually 0.01 to 10 μm, preferably 0.1 to 5 μm.

The subbing layer can be formed by the coating method comprising the steps of dissolving its components in a solvent and coating and drying the solution so-prepared, or by hot-melt extrusion lamination of the components.

Solvents usable in the coating method are conventional solvents such as water, alcohols, methyl ethyl ketone, toluene, dioxane and cyclohexanone.

When the lamination method is employed, co-extrusion with the first resin layer onto the base can also be carried out. Further, an overcoat layer may be laminated, for the purpose of preventing fusing between the thermal transfer recording ink sheet and the thermal transfer recording image receiving sheet.

(II) Thermal Transfer Recording Image Receiving Sheet and Method for Producing It (Part 2)

The thermal transfer recording image receiving sheet stated in claim 9 comprises a support composed of a base having the third resin layer on one side and the second resin layer on the other side, an intermediate layer having a porous structure and laminated on this third resin layer, and an image receiving layer laminated on the intermediate layer.

(II-a) Support

As bases, the materials and compositions described in the paragraph "Thermal Transfer Recording Image Receiving Layer (Part 1)" can be used, but pulp papers made of natural pulp, synthetic pulp or mixtures thereof are preferably used (in this specification, a base using such pulp paper is occasionally referred to as a paper base). Among these pulp papers, preferred is a natural pulp paper comprising wood pulp as principal component.

The paper base is made with a wire paper machine, etc. And after that, it is preferably subjected to calendering by use of a machine calender, a super calender or a heat calender for the improvement of smoothness. In the invention, a paper base which is coated with a pigment-containing resin layer for improving smoothness can also be employed favorably. Paper bases usable in the invention include woodfree paper, art paper, coat paper, single-side glazed paper, impregnated paper and paperboard.

In providing resin layers on both sides of a paper base, for the purpose of obtaining a high smoothness, the Bekk smoothness is made desirably 50 sec or more. A Bekk smoothness of not less than 100 sec, especially not less than 200 sec is particularly preferred. The thickness of the paper base is not particularly limited, but it is preferably 30 to 500 μm, especially 50 to 250 μm.

The paper base may contain, if necessary, additives such as sizing agents, fixers, fillers, antistatic agents, dyes, pigments, optical whitening agents, antioxidants and lubricants.

The support of the invention is formed by laminating the third resin layer on one side of the base and the second resin layer on the other side. The third resin layer is the same as the first resin layer described in "Thermal Transfer Recording Image Receiving Sheet (Part 1)" the resin used in the second resin layer is the same as that used in the first resin described in "Thermal Transfer Recording Image Receiving Sheet (Part 1)", and the additives used are also the same as those described in "Thermal Transfer Recording Image Receiving Sheet (Part 1)"; therefore, detailed description of them are omitted. Further, the hot-melt extrusion lamination method described in "Thermal Transfer Recording Image Receiving Sheet (Part 1)" can be favorably applied to the formation of the first resin layer and the second resin layer on the base and, if necessary, the surface of the resin layers may be subjected to calendering or embossing.

In the invention, the compositions of the third resin layer and the second resin layer may be the same or different.

The thicknesses of the third resin layer and the second resin layer are each in a range of usually 5 to 100 μm, preferably 10 to 50 μm and especially 15 to 40 μm.

(II-b) Intermediate Layer Having a Porous Structure is laminated on the surface of the third resin layer of the above support. Such an intermediate layer having a porous structure can be formed by methods known in the art.

Suitable methods include (1) a method of coating and drying a coating solution comprising a solvent dissolving a resin and a solvent not dissolving the resin but compatible with the solvent dissolving the resin, (2) a method of coating a coating solution containing hollow particles, or a method of laminating a composition containing hollow particles, (3) a method of coating a coating solution to which conventional foaming agents are added, a method comprising the steps of melt extruding and then allowing foaming agents to form froths, (4) a method of coating a coating solution to which froths are contained by means of mechanical stirring, (5) a method of incorporating an inactive gas at the time of melt extrusion, and (6) a method of dipping a layer comprising a solvent-soluble component and a solvent-insoluble component into a solvent which dissolves only the solvent-soluble component, in this way the solvent-soluble component is dissolved into the solvent to form a porous layer.

It is preferable that the intermediate layer according to the invention be made porous by use of the method described in (6), because large pores can be formed and thereby high thermal insulation effects and high cushioning properties are provided and, moreover, images free from unevenness can be obtained in high sensitivities and high densities in the image forming process described later.

In performing the method of (6), one particularly preferred procedure comprises the steps of coating a coating solution containing a solvent in which a resin is dissolved, dipping the coated material into a liquid incapable of dissolving the resin but capable of dissolving the solvent to solidify the resin, and then drying it.

By use of this method, a desired porous layer can be formed smoothly; but a porous layer having a more uniform and flatter surface can be formed by incorporating a certain liquid compound insoluble in the solvent by itself at the coating temperature.

As resins to form such a porous layer, there can be used singly or in combination of two or more kinds of resins selected from polyester type resins, styrene type resins, polyolefine type resins such as polyvinyl chlorides and ethylene-vinyl acetate copolymers, polyvinyl acetal type resins such as polyvinyl formals and polyvinyl butyrals, cellulosic resins such as nitrocellulose, acrylic resins such as polymethyl methacrylates, polycarbonates, polyarylates, polyimides, polysulfones, polyether sulfones and polyacrylonitriles.

Examples of the usable solvents include acetone, dioxane, dimethylformamide and dimethyl sulfoxide. And examples of the liquids incapable of dissolving the resin but capable of dissolving the solvents include water and alcohols.

Examples of the liquid compound insoluble in the solvent by itself at the coating temperature include stabilizing auxiliaries such as metal soaps, epoxy compounds and organic metal compounds such as butyl tin compounds.

This porous layer may contain, when necessary, additives such as antioxidants, heat stabilizers, UV absorbents, fillers, pigments and optical whitening agents within the limits not harmful to the essence of the invention.

In addition, plasticizers or heat fusible compounds may also be contained as a sensitizer. The porous layer can be formed by the method described in Japanese Pat. O.P.I. Pub. No. 252793/1988, etc.

The porous intermediate layer according to the invention is in the range of usually 1 to 50 μm, preferably 5 to 30 μm.

For enhancing the adhesion between the support and the intermediate layer, the resin layer of the support may be subjected to surface treatment.

In performing this surface treatment, the method for surface treatment described in "Thermal Transfer Recording Image Receiving Sheet (Part 1)" can be employed.

(II-c) Image Receiving Layer

In the invention, an image receiving layer is laminated on the above porous intermediate layer.

This image receiving layer is the same as that described in paragraph (I-c) in "Thermal Transfer Recording Image Receiving Sheet (Part 1)"; therefore, explanation on it is omitted.

(II-d) Other Layers

A barrier layer may be provided between the image receiving layer and the porous intermediate layer, in order to prevent the intermediate layer from being damaged due to dissolution or other causes at the time of image receiving layer formation, or to prevent the dye from migrating into the intermediate layer in storage.

This barrier layer may have any resin composition or may be formed by any method, as long as the cushioning property and the thermal insulation property of the intermediate layer are not impaired.

For example, the barrier layer can be formed by coating a resin soluble in a solvent which does not dissolve the intermediate layer but dissolves the image receiving layer composition when the image receiving layer is formed, or by hot-melt extrusion lamination or heat and/or pressure transfer of a resin layer insoluble in a solvent which does dissolve the intermediate layer but dissolves the image receiving layer composition when the image receiving layer is formed.

The thickness of the barrier layer is properly selected within a range of usually 0.1 to 20 μm, preferably 0.3 to 10 μm.

Further, an overcoat layer may be laminated on the surface of the image receiving layer, for the purpose of preventing fusing between a thermal transfer recording ink sheet and a thermal transfer recording image receiving sheet.

(III) Thermal Transfer Recording Ink Sheet and Method for Manufacturing It

The thermal transfer recording ink sheet can be formed basically by laminating an ink layer on a support.

(III-a) Support

The material for the support is not particularly limited as long as it has a sufficient dimensional stability and a stability to the heat applied in recording using a thermal head; examples thereof include tissue paper such as condenser paper, glassine paper; and films of heat resistant plastics such as polyethylene terephthalates, polyethylene naphthalares, polyamides, polyimides, polycarbonates, polysulfones, polyvinyl alcohols, cellophane, polystyrene.

The thickness of the support is preferably 2 to 10 μm

The form of the support is not particularly limited and may be any of broad films or sheets, narrow tapes and cares.

(III-b) Ink Layer

The ink layer contains a thermo-diffusible dye and a binder as essential components, when it is used to transfer an image to a thermal transfer recording image receiving sheet by the thermal diffusion transfer method.

Thermo-diffusible dyes include cyan dyes, magenta dyes and yellow dyes. As cyan dyes, the conventional naphthoquinone dyes, anthraquinone dyes and azomethine dyes are used.

Examples of the magenta dyes include the conventional anthraquinone dyes, azo dyes and azomethine dyes.

Examples of the yellow dyes include the conventional methine dyes, azo dyes, quinophthaloin dyes and anthraisothiazole dyes.

Particularly preferred thermo-diffusible dyes are azomethine dyes obtained by coupling of a compound having an open chain or closed chain active methylene group with an oxidation product of a p-phenylenediamine derivative or an oxidation product of a p-aminophenol derivative, and indoanitine dyes obtained by coupling of a phenol or naphthol derivative with an oxidation product of a p-phenylenediamine derivative or an oxidation product of a p-aminophenol derivative.

The thermo-diffusible dye contained in the thermo-diffusible dye containing ink layer may be any of the yellow dye, magenta dye and cyan dye when formation of monochrome images is intended.

To form chelate dye images between a thermo-diffusible dye and a metal ion, a metal-ion-containing compound is incorporated in the image receiving-layer, and a dye capable of forming a chelate in conjunction with this metal-ion-containing compound is used as the thermo-diffusible dye.

As a dye capable of forming a chelate in conjunction with a metal-ion-containing compound, a suitable one can be selected from various conventional dyes. Typical examples thereof include the cyan image forming dyes (hereinafter referred to as cyan dyes), the magenta image forming dyes (hereinafter referred to as magenta dyes) and the yellow image forming dyes (hereinafter referred to as yellow dyes) described in Japanese Pat. O.P.I. Pub. Nos. 78893/1984, 109349/1984 and Japanese Pat. Appl. Nos. 213303/1990, 14719/1990, 203742/1990.

Among the above dyes, preferred are those capable of forming at least a two-site chelate in conjunction with the metal-ion-containing. Typical examples of such dyes are those represented by the following formula:

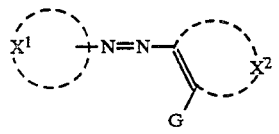

In the formula, $X^1$ represents a group of atoms necessary to form an aromatic carbocycle or an aromatic heterocycle, in which at least one ring is composed of 5 to 7 atoms and at least one carbon atom adjacent to the carbon atom linked with the azo group is monosubstituted with a nitrogen atom or a chelating group; $X^2$ represents an aromatic carbocycle or an aromatic heterocycle, in each of which at least one ring is composed of 5 to 7 atoms; and G represents a chelating agent.

Irrespective of the type of dyes used, there may be contained two or more of the above three types of dyes, or other thermo-diffusible dyes, according to the color tone of an image to be formed.

These thermo-diffusible dyes are used in amounts of usually 5 to 70 wt %, preferably 20 to 60 wt % of the ink layer forming composition.

Suitable binders used in the ink layer are cellulosic resins, polyvinyl acetal type resins, styrene type resins, acrylic type resins, rubber type resins, ionomer resins, olefine type resins, polyester resins, etc.

These binders may be used singly or in combination of two or more kinds.

In addition, the ink layer may properly contain various additives, such as releasing compounds, fillers and curing agents reactive to the binder component (e.g., isocyanates, irradiation-activated compounds including acrylates and epoxides). Moreover, there may also be added heat fusible materials to accelerate the transfer, such as the waxes and higher fatty esters described in Japanese Pat. O.P.I. Pub. No. 106997/1984.

(III-c) Other Layers

The thermal recording ink skeet is not limited to the double-layered structure comprising the support and the ink layer, and other layers may also be formed.

For example, an overcoat layer may be provided on the surface of the ink layer in order to prevent fusing with a thermal transfer recording image receiving sheet or offsetting of a thermo-diffusible dye. The support may have a subbing layer, for the purposes of improving the adhesion to the binder and preventing transfer or migration of the dye to the support side. Further, a backing layer may be provided on the reverse side of the support (oppositely with the ink layer), in order to prevent the thermal head from fusing or sticking to the support and the thermal transfer recording ink sheet from creasing.

The thickness of the overcoat layer, subbing layer or backing layer is usually 0.1 to 1 μm.

The thermal transfer recording ink sheet can be produced by coating and drying, on the support, a coating solution for ink layer prepared by dispersing or dissolving the above ink layer components.

The above binders are used, singly or in combination of two or more types, after being dissolved or dispersed to a latex-form in a solvent.

Usable solvents are water, ethanol, tetrahydrofuran, methyl ethyl ketone, toluene, xylene, chloroform, dioxane, acetone, cyclohexanone, n-butyl acetate, etc.

The coating of the ink layer can be performed by gravure coating in which the face is coated in sequence, extrusion coating, wire bar coating or roll coating.

The ink layer may be formed as a layer containing monochromatic thermo-diffusible dyes over the whole support surface or on parts of the support surface, or it may be formed in three layers comprising a yellow ink layer, a magenta ink layer and a cyan ink layer arranged on the same plane in a prescribed repetition order, over the whole support surface or on parts of the support surface. Further, a black ink layer containing a black image forming material may be provided in addition to the above three ink layers. Such a black ink layer works in providing a sharp image whether it is used in diffusion transfer or in melt transfer.

The thickness of the ink layer so-prepared is usually 0.2 to 10 μm, preferably 0.3 to 3 μm.

For the sake of convenient handling, the thermal transfer recording ink sheet may have perforations or detection marks to detect the position at which the color changes.

(IV) Image Formation

In forming images, the ink layer of the thermal transfer recording ink sheet is brought into contact with the image receiving layer of the thermal transfer recording image receiving sheet, then heat energy is applied imagewise to the interface of the ink layer and the image receiving layer.

Thereupon the thermo-diffusible dye in the ink layer thermally diffuses or sublimates in an amount corresponding to the amount of heat energy applied at the of this image formation and moves to the image receiving layer side, where it is received to form a dye image (a chelate dye image).

As a heat source to apply the heat energy, a thermal head is usually used. Other conventional ones, such as laser beams, infrared flash lamps and hot pens, can also be employed.

When a thermal head is used as a heat source, the heat energy applied can be changed continuously or stepwise by modulating the voltage or pulse width applied to the thermal head.

When a laser beam is used as a heat source, the amount of the heat energy can be changed by varying the luminous energy or irradiation area of the laser beam.

In this case, it is preferred that a laser beam absorbing material (e.g., carbon black or a near infrared ray absorbing material for a semiconductor laser) be present in or near the ink layer.

In forming images by use of a laser beam, it is preferable that the thermal transfer recording ink sheet be closely contacted with the thermal transfer recording image receiving sheet.

Using a dot generator provided with a built-in accusto-optical element makes it possible to apply the heat energy in an amount corresponding to the size of a dot.

When an infrared flash lamp is used as a heat source, it is preferable that heating be carried out through a colored layer such as black, similarly to the case of laser beams. Heating may also be performed through a pattern continuously expressing shades of an image in black or the like or through a dot pattern. Further, heating may be performed using jointly a colored layer such as a solid black layer and a negative pattern corresponding to a negative of the above pattern.

The heat energy may be applied from the thermal transfer recording ink sheet side, from the thermal transfer recording image receiving sheet side, or from the both sides. But, when priority is given to energy saving, it is preferred to perform heating from the thermal transfer recording ink sheet side.

Through the procedure described above, a monochromatic image is recorded on the image receiving layer of the thermal transfer recording image receiving sheet, and a color image formed by combination of respective colors, like a color photograph, can be obtained according to the following procedure.

For example, when thermal transfer is carried out by exchanging yellow, magenta, cyan and, if necessary, black thermal transfer recording ink sheets one by one, a color image like a color photograph can be obtained in combination of the respective colors. Such a color photograph-like color image can also be obtained using a thermal transfer recording ink sheet having areas coated in respective colors, instead of the above monochromatic thermal transfer recording ink sheets of respective colors. This method has an advantage that the exchange of thermal transfer recording ink sheets is not needed.

After an image is formed as above, a heat treatment may be performed in the above manner in order to improve image preservability. For example, heat is applied all over the image formed area with a thermal head using non-ink portions of an ink sheet, or additional heating with a heat roll may also be performed. Further, when a near infrared ray absorber is contained, the image formed area may be exposed to an infrared flash lamp.

The purpose of the heat treatment is to make the dye diffuse much deeper into the image receiving layer; therefore, it is preferable that the heating be made from the support side of the image receiving layer irrespectively of heating means.

EXAMPLES

The present invention is hereinafter described in detail with examples, but the invention is by no means limited to these examples. In the examples to follow, the term "parts" means "parts by weight as an active ingredient" unless otherwise specified.

Examples 1 to 36

1. Thermal Transfer Recording Image Receiving Sheets

The thermal transfer recording image receiving sheets shown in Tables 1 and 2 were prepared in the following procedure.

Supports a; a 350-μm thick white-pigment-containing white polyvinyl chloride film (Sumilite VSS 3101 made by Sumitomo Bakelite Co.)

b; a 125-μm thick transparent polyethylene terephthalate film (S made by Diafoil Hoechst Co.)

c; a 350-μm thick white-pigment-containing white polyethylene terephthalate film (Melinex made by Imperial Chemical Ind. Ltd.)

d; a 250-μm thick white-pigment-containing white polyethylene terephthalate film (Crisper made by Toyobo Co.)

e; a 100-μm thick white polyethylene terephthalate film (W900J made by Diafoil Hoechst Co.)

f; a support formed by steps of coating and drying the following adhesive layer coating solution on a 50-μm thick white polyethylene terephthalate film (W900J made by Diafoil Hoechst Co.) by wire bar coating to a dry thickness of 2 μm, overlaying the adhesive-layer-coated film so-prepared on both sides of a 60-μm thick woodfree paper base having a smoothness of 250 sec, press-bonding them with a heat roll while taking caution not to entrain bubbles, and heating them for 1 hour at 100° C. to cure the adhesive layer, adhesive layer coating solution used:

| | |
|---|---|
| Polyester resin | 6 parts |

-continued

| | |
|---|---|
| (Vylon 200 made by Toyobo Co.) | |
| Curing agent | 4 parts |
| (Coronate HL made by Nippon Polyurethane Ind. Co.) | |
| Methyl ethyl ketone | 80 parts |
| Cyclohexanone | 10 parts |

Laminating Compositions (compositions comprising polypropylene as principal component)

The following polypropylene compositions were each melted and kneaded thoroughly and then laminated by hot-melt extrusion on the above base in a thickness of 10 to 50 μm to form a laminating layer comprising polypropylene as principal component.

a; a polypropylene having a density of 0.90 g/cm$^3$ and a melt flow rate of 9 g/10 min.

b; a polypropylene containing 5 parts of titanium oxide (average particle size: 0.3 μm) and having a density of 0.90 g/cm$^3$ and a melt flow rate of 9 g/10 min.

c; a polypropylene containing 12 parts of titanium oxide (average particle size: 0.3 μm) and having a density of 0.90 g/cm$^3$ and a melt flow rate of 7 g/10 min.

d; a polypropylene containing 12 parts of cross-linked styrene-acrylate hollow resin particles (average particle size: 0.4 μm, JSR Hollow Particles SX863 (P) made by Japan Synthetic Rubber Co.) and having a density of 0.90 g/cm$^3$ and a melt flow rate of 7 g/10 min.

Subbing Layers

The following subbing layers were formed on the base (subbing layers classified as A in Table 1), on the laminating layer (subbing layers classified as B in Table 1) and on the base oppositely with the image receiving layer (subbing layers classified as B in Table 1).

a; a subbing layer formed by coating and drying an ethyl acetate solution dissolving 5 parts of alkyl titanate (Orgatix PC-426 made by Matsumoto Kosho Co.) to a thickness of 0.1 μm.

b; a subbing layer formed by coating and drying a 8/32 water/methanol mixed solvent solution dissolving 2.5 parts of a titanium-modified water-borne resin (Orgatix WS680 made by Matsumoto Kosho Co., active component: 11%) to a thickness of 0.1 μm.

c; a subbing layer formed by coating and drying a toluene solution dissolving 10 parts of a composition comprising a ethylene-vinyl acetate copolymer (Adcote AD-1790-15 made by Toyo Morton Co.) as principal component to a thickness of 0.5 μm.

d; a subbing layer formed by coating and drying the following subbing layer coating solution to a thickness of 0.5 μm, and curing the coated layer by heat treatment at 100° C. for 1 hour, the subbing layer coating solution comprised

| | |
|---|---|
| Acryl type resin | 7 parts |
| (Desmophene A450 made by Sumitomo Bayer Urethane Co.) | |
| Curing agent | 3 parts |
| (Coronate HL made by Nippon Polyurethane Co.) | |
| Methyl ethyl ketone | 80 parts |
| Cyclohexanone | 10 parts |

e; a subbing layer formed as in d to a thickness of 1.0 m, using a subbing layer coating solution comprising

| | |
|---|---|
| Urethane type resin | 7 parts |
| (made by Takeda Chem. Ind., Ltd. Takelac A-367H) | |
| Curing agent | 3 parts |

-continued

| | |
|---|---|
| (made by Takeda Chem. Ind., Ltd. Takenate A-7 | |
| Methyl ethyl ketone | 80 parts |
| Cyclohexanone | 10 parts |

f; a subbing layer formed as in d to a thickness of 1.0 μm, using a subbing layer coating solution comprising

| | |
|---|---|
| Polyester type resin | 7 parts |
| (Vylon 103 made by Toyobo Co.) | |
| Curing agent | 3 parts |
| (Coronate L made by Nippon Polyurethane Co.) | |
| Methyl ethyl ketone | 80 parts |
| Cyclohexanone | 10 parts |

g; a subbing layer formed as in d to a thickness of 1.0 μm, using a subbing layer coating solution comprising

| | |
|---|---|
| Epoxy resin | 5 parts |
| (Epikote 1001 made by Yuka-Shell Epoxy Co.) | |
| Curing agent | 5 parts |
| (Epomate B-002 made by Yuka-Shell Epoxy Co.) | |
| Methyl ethyl ketone | 80 parts |
| Cyclohexanone | 10 parts |

h; prior to forming a subbing layer, the base surface was subjected to corona discharge.

i; prior to forming a subbing layer, the base surface was irradiated for 10 min with a UV ray (low wavelength type: 189 nm).

j; prior to forming a subbing layer, the base surface was irradiated with an electron beam using a 750-kv electron beam accelerator.

k; prior to forming a subbing layer, the base surface was subjected to a low temperature plasma treatment by being placed in a plasma reaction apparatus of cylindrical flow and polarized external polar type filled with an Ar atmosphere, followed by introduction of acrylonitrile monomers to form a plasma-polymerized thin layer of acrylonitrile on the base surface.

Image Receiving Layers

The following image receiving layer coating solutions were coated and dried to form image receiving layers having a thickness of 20 μm (a and b) and that of 10 μm (c and d).

a; an image receiving layer coating solution comprising

| | |
|---|---|
| Polyvinyl chloride type resin | 6.0 parts |
| (vinyl chloride-p-t-butyl benzoate copolymer, Tg: 79° C., polymerization degree: 670, vinyl chloride content: 86.9%) | |
| Epoxy resin | 3.5 parts |
| (Epotohto YD-014 made by Tohto Chemical Co.) | |
| Polyester-modified silicone resin | 0.5 part |
| (X-24-8300 made by Shin-Etsu Chemical Co.) | |
| Methyl ethyl ketone | 20 parts |
| Dioxane | 60 parts |
| Cyclohexanone | 10 parts |

b; an image receiving layer coating solution comprising

| | |
|---|---|
| Styrene type resin | 6.0 parts |
| (Kane Ace B-11A made by Kanegafuchi Chem. Ind. Co.) | |
| Polyether polyol | 2.5 parts |
| (Desmophene 550U made by Sumitomo Bayer Urethane Co.) | |
| Light stabilizer | 1.0 part |
| (Irgafos 168 made by Ciba Geigy AG) | |
| Polyester-modified silicone resin | 0.5 part |
| (X-24-8300 made by Shin-Etsu Chemical Co.) | |
| Methyl ethyl ketone | 60 parts |
| Dioxane | 20 parts |
| Cyclohexanone | 10 parts |

c; an image receiving layer coating solution comprising

| | |
|---|---|
| Vinyl chloride type resin | 4.5 parts |
| (vinyl chloride-dimethyl fumarate copolymer, Tg: 74° C., polymerization degree: 620, vinyl chloride content: 83.5%) | |
| Polyether polyol | 2.0 parts |
| (Desmophene 550U made by Sumitomo Bayer Urethane Co.) | |
| Metal-containing compound | 3.0 parts |
| ($[Ni^{2+}(NH_2COCH_2NH_2)_3]\ 2[(C_6H_5)_4B]^-$) | |
| Polyester-modified silicone resin | 0.5 part |
| (X-24-8300 made by Shin-Etsu Chemical Co.) | |
| Methyl ethyl ketone | 60 parts |
| Dioxane | 20 parts |
| Cyclohexanone | 10 parts |

d; an image receiving layer coating solution comprising

| | |
|---|---|
| Styrene type resin | 4.0 parts |
| (JSR AES110 made by Japan Synthetic Rubber Co.) | |
| Polyester polyol | 2.0 parts |
| (Desmophene 670 made by Sumitomo Bayer Urethane Co.) | |
| Metal-containing compound | 2.5 parts |
| ($[Ni^{2+}(NH_2COCH_2NH_2)_3]\ 2[(C_6H_5)_4B]^-$) | |
| Zinc oxide | 1.0 part |
| (super fine particle zinc oxide Zn-100 made by Sumitomo Cement Co.) | |
| Polyester-modified silicone resin | 0.5 part |
| (X-24-8300 made by Shin-Etsu Chemical Co.) | |
| Methyl ethyl ketone | 60 parts |
| Dioxane | 20 parts |
| Cyclohexanone | 10 parts |

Composition Comprising Polyolefine as Principal Component

Each of the following compositions comprising polyolefine as principal component was melted and kneaded sufficiently, then extrusion laminated to a thickness of 10 to 50 μm on a base oppositely with the face on which an image receiving layer to be formed. A layer comprising polyolefine as principal component was thus prepared.

a; a polypropylene having a density of 0.90 g/cm$^3$ and a melt flow rate of 9 g/10 min.

b; a polypropylene containing 5 parts of titanium oxide (average particle size: 0.3 μm) and having a density of 0.90 g/cm$^3$ and a melt flow rate of 9 g/10 min.

c; a polypropylene containing 12 parts of titanium oxide (average particle size: 0.3 μm) and having a density of 0.90 g/cm$^3$ and a melt flow rate of 7 g/10 min.

d; a polypropylene containing 12 parts of cross-linked styrene-acrylate hollow resin particles (average particle size: 0.4 μm, JSR Hollow Particles SX863 (P) made by Japan Synthetic Rubber Co.) and having a density of 0.90 g/cm$^3$ and a melt flow rate of 7 g/10 min.

e; a low density polyethylene having a density of 0.914 g/cm$^3$ and a melt flow rate of 7.0 g/10 min.

f; a low density polyethylene containing 10 parts of titanium oxide (average particle size: 0.3 μm) and having a density of 0.914 g/cm$^3$ and a melt flow rate of 7.0 g/10 min.

2. Thermal Transfer Recording Ink Sheets

The ink layer coating solutions shown below were prepared, and each of them was coated by wire coating g on the corona-discharge-treated surface of a 6-μm thick polyethylene terephthalate film (Lumiler F53N made by Toray Ind. Inc.) to a dry coating thickness of 1 μm. On the other side of the film, a nitrocellulose solution containing 50 wt % silicone resin (Dai-Allomer SP-712 made by Dainichiseika Co.) was coated by wire bar coating to a dry coating thickness of 0.3 μm to provide a backcoating layer. Thermal transfer recording ink sheets shown in Tables 1 and 2 were thus prepared. a; an ink layer coating solution comprising

| | |
|---|---|
| Thermo-diffusible dye (Kayaset Blue 714 made by Nippon Kayaku Co.) | 3.0 parts |
| Polyvinyl butyral (S-Lec BX-1 made by Sekisui Chemical Co.) | 3.0 parts |
| Methyl ethyl ketone | 84 parts |
| Cyclohexanone | 10 parts |

b; an ink layer coating solution comprising

Thermo-diffusible dye 2.5 parts

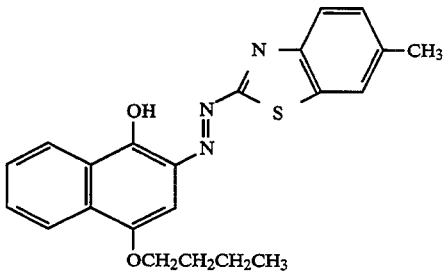

| | |
|---|---|
| Polyvinyl butyral (S-Lec BX-1 made by Sekisui Chemical Co.) | 2.5 parts |
| Methyl ethyl ketone | 40 parts |
| Dioxane | 45 parts |
| Cyclohexanone | 10 parts |

3. Formation of Images

An image was formed by steps of bringing the ink layer of the above thermal transfer recording ink sheet and the image receiving layer of the above thermal transfer recording image receiving sheet into contact with each other, and applying the thermal head to the support side of the ink sheet under the conditions described below.

Then, the thermal transfer recording ink sheet was peeled from the thermal transfer recording image receiving sheet, so that an image was recorded on the image receiving sheet.

After the image recording, the printing unevenness, transfer sensitivity, transfer density and curling of the transferred image as well as the adhesion of the image receiving layer were evaluated using the following criteria as shown in Tables 3 and 4.

Lineal density in primary scanning and secondary scanning: 8 dots/mm

Recording power:0.6 W/dot

Heating time of the thermal head: adjusted stepwise within a range from 20 msec (energy applied: about $11.2\sim10^{-3}$J) to 2 μm sec (energy applied: about $1.12\sim10^{-3}$J)

Printing Unevenness

The printing unevenness of the transferred image was visually checked.

A: printing unevenness was scarcely observed.

B: printing unevenness was slightly observed.

C: printing unevenness was observed.

Transfer Sensitivity

The amount of energy applied for giving a reflection density of 1.0 (E) was measured with an optical densitometer for judgement.

A: $E\leqq4.8\times10^{-3}$[J]

B: $4.8\times10^{-3}$[J]$<E\leqq5.2\times10^{-3}$[j]

C: $5.2\times10^{-3}$[J]$<E\leqq5.6\times10^{-3}$[J]

D: $5.6\times10^{-3}$[J]$<E$

Transfer Density The maximum reflection density (OD value) of the image was measured with an optical densitometer.

A: OD value was 2.5 and above.

B: OD value was 2.0 to 2.5.

C: OD value was 1.7 to 2.0.

D: OD value was 1.7 and below.

Curling

The degree of curling was measured with a curl gauge, its value is expressed as a reciprocal (X) of the radius of curvature given in meters (before recording, the values were all within a range of 0 to 0.5).

A: $X<0.5$

B: $0.5<X\leqq I$

C: $1<X\leqq2$

D: $2\leqq X$

Adhesion

Cuts were made in the form of a grid containing 2 mm×2 mm squares on the image receiving layer side to a depth exceeding the thickness of the polypropylene layer. Then, a tape peeling test was made (Scotch Mending Tape 810 made by Sumitomo 3M Co. was used) to evaluate the adhesive strength.

A: no peeling was observed.

B: only a slight peeling was observed near the cut.

C: less than 20% in number of the squares in the grid were peeled off.

D: more than 20% in number of the squares in the grid were peeled off.

Comparative Examples 1 to 8

The thermal transfer recording image receiving sheets and the thermal transfer recording ink sheets shown in Table 2, were prepared. After image recording, the printing unevenness, transfer sensitivity, transfer density and curling of the transferred image as well as the adhesion of the image receiving layer were evaluated using the same criteria as those in Examples 1 to 36. The results obtained are shown in Tables 4.

Supports g; a 100-μm thick coat paper having a Bekk smoothness of 1500 sec on both sides Laminating Composition (composition comprising polypropylene as principal component)

Instead of the composition comprising polypropylene as principal component, layers having the following compositions were formed.

e; a low density polyethylene having a density of 0.914 g/cm$^3$ and a melt flow rate of 7.0 g/10 min.

f; a low density polyethylene containing 10 parts of titanium oxide (average particle size: 0.3 μm) and having a density of 0.914 g/cm$^3$ and a melt flow rate of 7.0 g/10 min.

TABLE 1

| | Thermal Transfer Recording Image Receiving Sheet | | | | | | | |
|---|---|---|---|---|---|---|---|---|
| | Composition Comprising Polyolefine as Principal Component | Subbing Layer C | Support | Subbing Layer A | Composition Comprising Polypropylene as Principal Component | Subbing Layer B | Image Receiving Layer | Thermal Transfer Recording Ink Sheet |
| Example 1 | — | — | a | — | a 10 | — | c | b |
| Example 2 | — | — | a | a | a 10 | — | c | b |
| Example 3 | — | — | a | — | a 10 | b | c | b |
| Example 4 | — | — | a | a | a 10 | b | c | b |
| Example 5 | e 30 | — | b | c | c 40 | b | b | a |
| Example 6 | e 30 | c | b | c | c 40 | b | b | a |
| Example 7 | — | — | c | a | c 50 | e | c | b |
| Example 8 | — | — | c | b | c 50 | e | c | b |
| Example 9 | — | — | c | c | c 50 | e | c | b |
| Example 10 | — | — | c | d | c 50 | e | c | b |
| Example 11 | — | — | c | e | c 50 | e | c | b |
| Example 12 | — | — | c | f | c 50 | e | c | b |
| Example 13 | — | — | c | g | c 50 | e | c | b |
| Example 14 | — | — | d | h.a | a 30 | k.e | d | b |
| Example 15 | — | — | d | h.a | b 30 | k.e | d | b |
| Example 16 | — | — | d | h.a | c 30 | k.e | d | b |
| Example 17 | — | — | d | h.a | d 30 | k.e | d | b |
| Example 18 | c 20 | — | e | b | c 25 | f | b | a |
| Example 19 | c 20 | a | e | b | c 25 | f | b | a |

TABLE 2

| | Thermal Transfer Recording Image Receiving Sheet | | | | | | | |
|---|---|---|---|---|---|---|---|---|
| | Composition Comprising Polyolefine as Principal Component | Subbing Layer C | Support | Subbing Layer A | Composition Comprising Polypropylene as Principal Component | Subbing Layer B | Image Receiving Layer | Thermal Transfer Recording Ink Sheet |
| Example 20 | c 20 | b | e | b | c 25 | f | b | a |
| Example 21 | c 20 | c | e | b | c 25 | f | b | a |
| Example 22 | c 20 | d | e | b | c 25 | f | b | a |
| Example 23 | c 20 | e | e | b | c 25 | f | b | a |
| Example 24 | c 20 | f | e | b | c 25 | f | b | a |
| Example 25 | c 20 | g | e | b | c 25 | f | b | a |
| Example 26 | c 15 | c | e | b | a 25 | f | d | b |
| Example 27 | c 15 | c | e | b | b 25 | f | d | b |
| Example 28 | c 15 | c | c | b | c 25 | f | d | b |
| Example 29 | c 15 | c | c | b | d 25 | f | d | b |
| Example 30 | a 20 | a | f | i.f | d 25 | j.b | b | a |
| Example 31 | b 20 | a | f | i.f | d 25 | j.b | b | a |
| Example 32 | c 20 | a | f | i.f | d 25 | j.b | b | a |
| Example 33 | d 20 | a | f | i.f | d 25 | j.b | b | a |
| Example 34 | e 20 | a | f | i.f | d 25 | j.b | b | a |
| Example 35 | f 20 | a | f | i.f | d 25 | j.b | b | a |
| Example 36 | g 20 | a | f | i.f | d 25 | j.b | b | a |
| Comp. Example 1 | — | — | c | a | c 3 | e | c | b |
| Comp. Example 2 | — | — | c | a | c 120 | e | c | b |
| Comp. Example 3 | c 20 | — | g | b | c 25 | f | b | a |
| Comp. Example 4 | c 20 | a | g | b | c 25 | f | b | a |
| Comp. Example 5 | — | — | d | h.a | e 30 | k.e | d | b |
| Comp. Example 6 | — | — | d | h.a | f 30 | k.e | d | b |
| Comp. Example 7 | c 20 | a | e | b | e 25 | f | b | a |
| Comp. Example 8 | c 20 | a | e | b | f 25 | f | b | a |

TABLE 3

| | Printing Unevenness | Transfer Sensitivity | Transfer Density | Curling | Adhesion |
|---|---|---|---|---|---|
| Example 1 | B | B | B | A | C |
| Example 2 | B | B | B | A | C |
| Example 3 | B | B | B | A | C |
| Example 4 | B | B | B | A | B |
| Example 5 | A | B | A | B | B |
| Example 6 | A | B | A | B | B |
| Example 7 | A | B | A | A | B |
| Example 8 | A | B | A | A | B |

TABLE 3-continued

| | Printing Unevenness | Transfer Sensitivity | Transfer Density | Curling | Adhesion |
|---|---|---|---|---|---|
| Example 9 | A | B | A | A | B |
| Example 10 | A | B | A | A | B |
| Example 11 | A | B | A | A | B |
| Example 12 | A | B | A | A | B |
| Example 13 | A | B | A | A | B |
| Example 14 | A | A | A | A | B |
| Example 15 | A | A | A | A | B |
| Example 16 | A | A | A | A | B |
| Example 17 | A | A | A | A | B |
| Example 18 | A | A | A | B | B |
| Example 19 | A | A | A | A | B |

TABLE 4

| | Printing Unevenness | Transfer Sensitivity | Transfer Density | Curling | Adhesion |
|---|---|---|---|---|---|
| Example 20 | A | A | A | A | B |
| Example 21 | A | A | A | A | B |
| Example 22 | A | A | A | A | B |
| Example 23 | A | A | A | A | B |
| Example 24 | A | A | A | A | B |
| Exmaple 25 | A | A | A | A | B |
| Example 26 | A | A | A | B | B |
| Example 27 | A | A | A | B | B |
| Example 28 | A | A | A | B | B |
| Example 29 | A | A | A | B | B |
| Example 30 | A | A | A | A | B |
| Example 31 | A | A | A | A | B |
| Example 32 | A | A | A | A | B |
| Example 33 | A | A | A | A | B |
| Example 34 | A | A | A | A | B |
| Example 35 | A | A | A | A | B |
| Example 36 | A | A | A | A | B |
| Comp Example 1 | C | D | D | A | B |
| Comp Example 2 | A | C | B | B | B |
| Comp Example 3 | D | D | D | A | B |
| Comp Example 4 | D | D | D | A | B |
| Comp Example 5 | A | B | C | A | B |
| Comp Example 6 | A | C | C | A | B |
| Comp Example 7 | A | B | C | C | B |
| Comp Example 8 | A | C | C | C | B |

Examples 37 to 68

1. Thermal Transfer Recording Image Receiving Sheets

The thermal transfer recording image receiving sheets shown in Table 5 were prepared in the following procedure.

Supports

The following supports were prepared.

a; a support prepared by laminating a 25-μm thick transparent polyethylene terephthalate film, via urethane type adhesive layers, on both sides of a 100-μm thick coat paper having a Bekk smoothness of 1500 sec on both sides.

b; a support prepared by hot-melt extrusion lamination of a low density polyethylene having a density of 0.914 g/cm$^3$ and a melt flow rate of 7.0 g/10 min, to a thickness of 25 μm, on both sides of a 100-μm thick coat paper having a Bekk smoothness of 1500 sec on both sides.

c; a support prepared by hot-melt extrusion lamination of a low density polyethylene containing 10 parts of titanium oxide (average particle size: 0.3 μm) and having a density of 0.914 g/cm$^3$ and a melt flow rate of 7.0 g/10 min, to a thickness of 30 μm on the image receiving layer side and to a thickness of 20 μm on the other side, on both sides of a 125μm thick woodfree paper having a Bekk smoothness of 250 sec on both sides.

d; a polypropylene containing 10 parts of titanium oxide (average particle size: 0.3 μm) and having a density of 0.90 g/cm$^3$ and a melt flow rate of 7.0 g/10 min, to a thickness of 30 μm on the image receiving layer side and to a thickness of 20 μm on the other side, on both sides of a 125-μm thick woodfree paper having a Bekk smoothness of 250 sec on both sides.

e; a support prepared by hot-melt extrusion lamination of a low density polyethylene containing 10 parts of cross-linked styrene-acrylate hollow resin particles (JSR Hollow Particles SA863 (P) made by Japan Synthetic Rubber Co., average particle size: 0.4 μm) and having a density of 0.914 g/cm$^3$ and a melt flow rate of 7.0 g/10 min, to a thickness of 30 μm on the image receiving layer side and to a thickness of 20 μm on the other side, on both sides of a 120-μm thick woodfree paper having a Bekk smoothness of 250 sec on both sides.

Porous Intermediate Layers a; a porous intermediate layer formed by steps of mixing 100 parts of a solution comprising a 2/1 toluene/isopropyl alcohol mixed solvent dissolving 15 parts of polyurethane resin (Takelac T made by Takeda Chemical Co.) with 40 parts of water, then coating and drying the resulting slightly turbid solution on the above support to a thickness of 20 μm by wire bar coating.

b; a porous intermediate layer formed by steps of coating a coating solution of the following composition on the above support by wire bar coating, dipping the coated material in water for 60 sec for solidification, dipping it in hot water of 80° C. for making it porous, and drying to give a thickness of 20 μm, the coating solution for the intermediate layer comprised

| | |
|---|---|
| Polyether sulfone (4100P made by Mitsui Toatsu Co.) | 20 parts |
| Butyl tin laurate (Advastab T-12P made by Katsuta Kako Co.) | 2 parts |
| Epoxy compound (Advastab E-82 made by Katsuta Kako Co.) | 2 parts |
| Silica (average particle size: 0.015 μm) | 2 parts |
| Titanium oxide (average particle size: 0.3 μm) | 5 parts |
| Dimethylformamide | 69 parts |

c; a porous intermediate layer formed in the same manner as b, using a coating solution for making porous intermediate layer comprising

| | |
|---|---|
| Polyester (Elitel UE-3690 made by Unitika Ltd.) | 25 parts |
| Butyl tin laurate (BL-42A made by Akishima Kagaku Kogyo Co.) | 2 parts |
| Barium-zinc organic compound (LT701B made by Akishima Kagaku Kogyo Co.) | 2 parts |
| Silica (average particle size: 0.015 μm) | 2 parts |
| Calcium carbonate (average particle size: 0.015 μm) | 2 parts |
| Dimethylformamide | 67 parts |

d; a porous intermediate layer formed in the same manner as b, using a coating solution for making porous intermediate layer comprising

| | |
|---|---|
| Polyacrylonitrile resin (Barex 6000N made by Mitsui Toatsu Co.) | 20 parts |
| Butyl tin laurate (BL-42A made by Akishima Kagaku Kogyo Co.) | 2 parts |
| Epoxy compound (LT701B made by Akishima Kagaku Kogyo Co.) | 2 parts |
| Silica (average particle size: 0.015 μm) | 2 parts |
| Titanium oxide (average particle size: 0.3 μm) | 5 parts |
| Dimethylformamide | 69 parts |
| Surface Treatment | |

Prior to the formation of the above intermediate layer, the supports were subjected to the following surface treatments.

a; a corona discharge treatment b; a flame treatment in which the surface is exposed to flames of a 107 air/methane molar ratio mixed gas c; an ozone treatment comprising a blow of air containing 25 g/m$^3$ of ozone d; a primer treatment comprising a coating of titanium tetraisopropoxide to a thickness of 0.2 μm e; a UV treatment in which the surface is exposed to a UV ray (low wavelength type: 189 nm) for 10 min.

f; a radiation treatment comprising irradiation of electron beams using a 750-kv electron beam accelerator g; a low temperature surface plasma treatment, in which a support is set in a plasma reaction apparatus of cylindrical flow and polarized external polar type, then subjected to Ar plasma treatment for 5 min and taken out of the apparatus into air.

h; a low temperature surface plasma treatment comprising steps of setting a support in a plasma reaction apparatus of cylindrical flow and polarized external polar type and introducing acrylonitrile monomers therein to form a thin plasma-polymerized polyacrylonitrile layer on the support surface.

Barrier Layers

The following barrier layers were formed.

a; a 1-μm thick barrier layer formed on the intermediate layer by wire bar coating of a barrier layer coating solution comprising

| | |
|---|---|
| Polyvinyl alcohol (Gohsenol GL-05 made by Nippon Syn. Chem. Co.) | 10 parts |
| Deionized water | 90 parts |

b; a 1-μm thick barrier layer formed on the intermediate layer by wire bar coating of a barrier layer coating solution comprising

| | |
|---|---|
| Polyvinyl acetacetal (S-Lec KW-1 made by Sekisui Chemical Co.) | 10 parts |
| Deionized water | 90 parts |

c; a 1-μm thick barrier layer formed on the intermediate layer by wire bar coating of a barrier layer coating solution comprising

| | |
|---|---|
| Gelatin | 9.7 parts |
| Hardener $[(NH_2CH{=}CHSO_2CH_2CONHCH_2{-})_2]$ | 0.3 parts |

-continued

| | |
|---|---|
| Deionized water | 90 parts |

d; a barrier layer provided on the intermediate layer by steps of coating the following barrier layer coating solution and the following adhesive layer coating solution, in order, so as to give respective dry thicknesses of 1.5 μm and 0.5 μm by wire bar coating, on one side of a 25-μm thick polyethylene terephthalate film (S made by Diafoil Hoechst Co.), drying the coatings to obtain a barrier layer transfer material, then superposing this barrier layer transfer material on the intermediate layer so as to have its adhesive layer contacting with the intermediate layer, and transferring the barrier layer onto the intermediate layer by applying heat and pressure by use of a heat roll (temperature: 180° C., pressure: 1.0 kg/cm$^2$, travelling speed: 0.5 cm/sec).

| | |
|---|---|
| barrier layer coating solution | |
| Polymethylmethacrylate (Dianal BR-88 made by Mitsubishi Rayon Co.) | 10.0 parts |
| Toluene | 80.0 parts |
| Cyclohexanone | 10.0 parts |
| adhesive layer coating solution | |
| Ethylene-vinyl acetate copolymer (Evaflex EV-40Y made by Mitsui Du Pont Polychemical Co.) | 35.0 parts |
| Toluene | 65.0 parts |

Image Receiving Layers

The following image receiving layer coating solutions were coated and dried by wire bar coating to form image receiving layers having a thickness of 20 μm (a and b) or 10 μm (c and d).

a; an image receiving layer coating solution comprising

| | |
|---|---|
| Vinyl chloride type resin (Laroflex MP-60 made by BASF AG) | 6.0 parts |
| Polyvinyl chloride (Sin-Etsu PVC TK300 made by Shin-Etsu Chemical Co.) | 3.5 parts |
| Polyester-modified silicone resin (X-24-8300 made by Shin-Etsu Chemical Co.) | 0.5 part |
| Methyl ethyl ketone | 60 parts |
| Dioxane | 20 parts |
| Cyclohexanone | 10 parts |

b; an image receiving layer coating solution comprising

| | |
|---|---|
| Styrene type resin (Kane Ace B-11A made by Kanegafuchi Chem. Ind. Co.) | 6.5 parts |
| Acryl polyol (Desmochene A565 made by Sumitomo Bayer Urethane Co.) | 2.0 parts |
| Light stabilizer (Irgafos 168 made by Ciba Geigy AG) | 1.0 part |
| Polyester-modified silicone resin (X-24-8300 made by Shin-Etsu Chemical Co.) | 0.5 part |
| Methyl ethyl ketone | 60 parts |
| Dioxane | 20 parts |
| Cyclohexanone | 10 parts |

c; an image receiving layer coating solution comprising

| | |
|---|---|
| Vinyl chloride type resin (vinyl chloride-dimethyl fumarate copolymer, Tg: 74° C., polymerization degree: 620, vinyl chloride content: 83.5%) | 4.5 parts |
| Ketone resin (Hilac 111 made by Hitachi Chemical Co.) | 2.0 parts |
| Metal-ion-containing compound $[[Ni^{2+}(NH_2COCH_2NH2)_2]\ 2[(C_6H_5)_4B]^-]$ | 3.0 parts |
| Polyester-modified silicone resin (X-24-8300 made by Shin-Etsu Chemical Co.) | 0.5 part |
| Methyl ethyl ketone | 60 parts |
| Dioxane | 20 parts |
| Cyclohexanone | 10 parts |

d; an image receiving layer coating solution comprising

| | |
|---|---|
| Styrene type resin (Litac-A 200PC made by Mitsui Toatsu Chem. Co.) | 4.0 parts |
| Polyether polyol (Desmophene 1915U made by Sumitomo Bayer Urethane Co.) | 2.0 parts |
| Metal-ion-containing compound $[[Ni^{2+}(NH_2COCH_2NH_2)_2]\ 2[(C_6H_5)_4B]^-]$ | 2.5 parts |
| Titanium oxide (Idemitsu Titania IT-UD made by Idemitsu Kosan Co.) | 1.0 parts |
| Polyester-modified silicone resin (X-24-8300 made by Shin-Etsu Chemical Co.) | 0.5 part |
| Methyl ethyl ketone | 60 parts |
| Dioxane | 20 parts |
| Cyclohexanone | 10 parts |

2. Thermal Transfer Recording Ink Sheets

The following ink layer coating solutions were prepared and each coated by wire bar coating on the corona discharged surface of a 6-μm thick polyethylene terephthalate (Lumiier F53N made by Toray Ind. Inc.) support to a dry coating thickness of 1 μm, and a nitrocellulose solution containing 50 wt % silicone resin (Dai-Allomer SP-712 made by Dainichiseika Co.) was coated by wire bar coating to a dry coating thickness of 0.3 μm on the other side of the support where no corona discharge treatment was applied, so that the thermal transfer recording ink. sheets shown in Table 5 were obtained.

a; an ink layer coating solution comprising

| | |
|---|---|
| Thermo-diffusible dye (Kayaset Blue 714 made by Nippon Kayaku Co.) | 3.0 parts |
| Polyvinyl butyral (S-Lec BX-1 made by Sekisui Chemical Co.) | 3.0 parts |
| Methyl ethyl ketone | 84 parts |
| Cyclohexanone | 10 parts |

b; an ink layer coating solution comprising

| | |
|---|---|
| Thermo-diffusible dye | 2.5 parts |

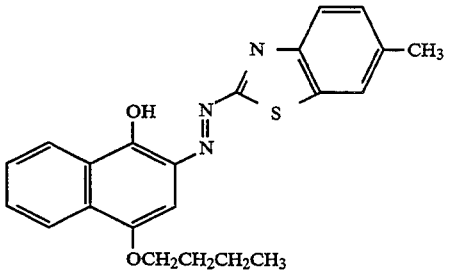

| | |
|---|---|
| Polyvinyl butyral | 2.5 parts |

-continued

| | |
|---|---|
| (S-Lec BX-1 made by Sekisui Chemical Co.) | |
| Methyl ethyl ketone | 40 parts |
| Dioxane | 45 parts |
| Cyclohexanone | 10 parts |

3. Formation of an Image

An image was formed by steps of bringing the ink layer of the above thermal transfer recording ink sheet and the image receiving layer of the above thermal transfer recording image receiving sheet into contact with each other, and applying the thermal head to the support side of the ink sheet under the conditions described below.

Then, the thermal transfer recording ink sheet was peeled from the thermal transfer recording image receiving sheet, so that an image was recorded on the image receiving sheet.

After the image recording, the printing unevenness, transfer sensitivity, transfer density, curling and bleeding of the transferred image as well as the adhesion and coatability of the image receiving layer were evaluated using the following criteria. The evaluation results are shown in Tables 7 and 8.

Lineal density in primary scanning and secondary scanning: 8 dots/mm

Recording power : 0.6 W/dot

Heating time of the thermal head: adjusted stepwise within a range from 20 msec (energy applied: about $11.2 \times 10^{-3}$J) to 2 msec (energy applied: about $1.12 \times 10^{-3}$J)

Printing Unevenness

The printing unevenness of the transferred image was visually checked.

A: printing unevenness was scarcely observed.

B: printing unevenness was slightly observed.

C: printing unevenness was observed.

Transfer Sensitivity

The amount of energy applied for giving a reflection density of 1.0 (E) was measured with an optical densitometer for judgement.

A: $E < 4.8 \times 10^{-3}$[J]

B: $4.8 \times 10^{-3}$[J] $< E < 5.2 \times 10^{-3}$[J]

C: $5.2 \times 10^{-3}$[J] $< E < 5.6 \times 10^{-3}$[J]

D: $5.6 \times 10^{-3}$[J] $< E$

Transfer Density

The maximum reflection density (OD value, at which the energy applied was the maximum) of the image was measured with an optical densitometer.

A: OD value was 2.5 and above.

B: OD value was 2.0 to 2.5.

C: OD value was 1.7 to 2.0.

D: OD value was 1.7 and be low.

Curling

The degree of curling was measured with a curl gauge, its value was expressed as a reciprocal (X) of the radius of curvature given in meters (before recording, the values were all within a range of 0 to 0.5).

A: $X < 0.5$

B: $0.5 \leqq X < 1$

C: $1 \leqq X < 2$

D: $2 \leqq X$

Bleeding

The bleeding of the recorded image was visually inspected when it was stored for 3 days and 1 week at 70° C.

A: no bleeding was observed after 1 week storing.

B: no bleeding was observed after 3 days, but a slight bleeding was observed after 1 week.

C: a slight bleeding was observed after 3 days, and bleeding was observed after 1 week.

D: bleeding was observed after 3 days.

Adhesion

Cuts were made in the form of a grid containing 2 mm×2 mm squares on the image receiving layer side, to a depth exceeding the thickness of the polypropylene layer. Then, a tape peeling test was made (Scotch Mending Tape 810 made by Sumitomo 3M Co. was used) to evaluate the adhesive strength.

A: no peeling was observed.

B: only a slight peeling was observed near the cut.

C: less than 20% in number of the squares in the grid were peeled off.

D: more than 20% in number of the squares in the grid were peeled off.

Coatability in Image Receiving Layer Coating. Whether or not the intermediate layer had been damaged in the coating was judged by visual inspection.

A: the image receiving layer was uniformly provided.

B: wire bar marks were slightly observed, and the coated face was partly uneven.

C: wire bar marks were observed, and the coated face was uneven.

Comparative Examples 9 to 15 The thermal transfer recording image receiving sheets and thermal transfer recording ink sheets shown in Table 6 were prepared. After image recording by use of them, the printing unevenness, transfer sensitivity, transfer density, curling and bleeding of the transferred image as well as the adhesion and coatability of the image receiving layer were evaluated using the same criteria as those in Examples 37 to 68. The results are shown in Table 8.

1. Thermal Transfer Recording Image Receiving Sheets Supports f; a support prepared by hot-melt extrusion lamination of a low density polyethylene having a density of 0.914 g/cm$^3$ and a melt flow rate of 7.0 g/10 min, to a thickness of 25 μm, on both sides of a 100-μm thick white polyethylene terephthalate (W410 made by Diafoil Hoechst Co.) film.

g; a support prepared by hot-melt extrusion lamination of a low density polyethylene containing 10 parts of titanium oxide (average particle size: 0.3 μm) and having a density of 0.914 g/cm$^3$ and a melt flow rate of 7.0 g/10 min, to a thickness of 30 μm on the image receiving layer side and a thickness of 20 μm on the other side of a 130-μm thick polypropylene type synthetic paper (Yupo FPG#130 made by Oji Yuka Goseishi Co.).

Intermediate Layers e; a 20-μm thick uniform and nonporous image receiving layer formed on the base by wire bar coating of an intermediate layer coating solution comprising

| | |
|---|---|
| Polyester (Elitel UE-3690 made by Unitika Ltd.) | 12.5 parts |
| Butyl tin laurate (BL-42A made by Akishima Kagaku Kogyo Co.) | 1.0 part |
| Barium-zinc organic compound (LT701B made by Akishima Kagaku Kogyo Co.) | 1.0 part |
| Silica (average particle size: 0.015 μm) | 1.0 part |
| Calcium carbonate (average particle size: 0.2 μm) | 1.0 part |
| Methyl ethyl ketone | 40.0 parts |
| Toluene | 37.5 parts |
| Cyclohexanone | 6.0 parts |

f; an intermediate layer formed in the same manner as in e, except that a coating solution of the following composition was used:

| | |
|---|---|
| Polyacrylonitrile (Barex 6000N made by Mitsui Toatsu Chem. Inc.) | 20 parts |
| Butyl tin laurate (BL-42A made by Akishima Kagaku Kogyo Co.) | 2 parts |
| Epoxy compound (LT701B made by Akishima Kagaku Kogyo Co.) | 2 parts |
| Silica (average particle size: 0.015 μm) | 2 parts |
| Titanium oxide (average particle size: 0.3 μm) | 5 parts |
| Dimethylformamide | 69 parts |

TABLE 5

| | Thermal Transfer Recording Image Receiving Sheet | | | | | Thermal Transfer Recording Ink Sheet |
|---|---|---|---|---|---|---|
| | Support | Intermediate Layer | Surface Treatment | Barrier Layer | Image Receiving Layer | |
| Example 37 | a | a | — | — | c | b |
| Example 38 | a | c | — | a | a | a |
| Example 39 | a | b | a | — | b | a |
| Example 40 | a | d | h | d | b | a |
| Example 41 | b | c | — | — | d | b |
| Example 42 | b | c | — | b | d | b |
| Example 43 | b | b | e | — | b | a |
| Example 44 | b | b | f | c | b | a |
| Example 45 | c | c | — | — | d | b |
| Example 46 | c | b | — | — | d | b |
| Example 47 | c | c | — | b | d | b |
| Example 48 | c | b | — | b | d | b |
| Example 49 | c | d | b | — | b | a |
| Example 50 | c | c | b | — | b | a |
| Example 51 | c | c | c | c | b | a |
| Example 52 | c | d | c | c | b | a |
| Example 53 | d | c | — | — | c | b |
| Example 54 | d | d | — | — | d | b |
| Example 55 | d | c | — | d | c | b |

TABLE 6

| | Thermal Transfer Recording Image Receiving Sheet | | | | | Thermal Transfer |
|---|---|---|---|---|---|---|
| | Support | Intermediate Layer | Surface Treatment | Barrier Layer | Image Receiving Layer | Recording Ink Sheet |
| Example 56 | d | d | — | c | d | b |
| Example 57 | d | c | — | — | b | a |
| Example 58 | d | b | d | — | a | a |
| Example 59 | d | c | d | c | b | a |
| Example 60 | d | b | d | d | a | a |
| Example 61 | e | b | d | — | a | a |
| Example 62 | e | d | — | — | b | a |
| Example 63 | e | b | — | c | a | a |
| Example 64 | e | d | — | c | b | a |
| Example 65 | e | c | a | — | d | b |
| Example 66 | e | c | g | — | c | b |
| Example 67 | e | c | g | c | c | b |
| Example 68 | e | c | a | c | d | b |
| Comp. Example 9 | e | — | — | — | d | b |
| Comp. Example 10 | f | — | — | — | c | b |
| Comp. Example 11 | g | e | — | — | d | b |
| Comp. Example 12 | c | e | — | b | d | b |
| Comp. Example 13 | c | f | b | — | b | a |
| Comp. Example 14 | d | e | d | — | b | a |
| Comp. Example 15 | d | e | d | c | b | a |

TABLE 7

| | Printing Unevenness | Transfer Sensitivity | Transfer Density | Curling | Bleeding | Adhesion | Coatability of Image Receiving Layer |
|---|---|---|---|---|---|---|---|
| Example 37 | B | B | B | B | A | A | C |
| Example 38 | B | B | B | B | A | A | B |
| Example 39 | B | A | A | B | B | A | B |
| Example 40 | B | A | A | B | A | A | B |
| Example 41 | B | B | B | B | A | B | C |
| Example 42 | B | B | B | B | A | B | B |
| Example 43 | B | A | A | A | B | A | B |
| Example 44 | B | A | A | A | A | A | B |
| Example 45 | B | B | B | A | A | B | C |
| Example 46 | B | A | A | A | A | B | B |
| Example 41 | B | B | B | A | A | B | B |
| Example 48 | B | A | A | A | A | B | B |
| Example 49 | B | A | A | A | B | A | B |
| Example 50 | B | B | B | A | B | A | B |
| Example 51 | B | B | A | A | A | A | B |
| Example 52 | B | A | A | A | A | A | B |
| Example 53 | B | B | A | A | A | A | C |
| Example 54 | B | A | A | A | A | B | B |
| Example 55 | B | B | A | A | A | B | B |

TABLE 8

| | Printing Unevenness | Transfer Sensitivity | Transfer Density | Curling | Bleeding | Adhesion | Coatability of Image Receiving Layer |
|---|---|---|---|---|---|---|---|
| Example 56 | B | A | A | A | A | B | B |
| Example 57 | B | B | A | A | C | A | C |
| Example 58 | B | A | A | A | B | A | B |
| Example 59 | B | B | A | A | A | A | B |
| Example 60 | B | A | A | A | A | A | B |
| Example 61 | B | A | A | A | B | B | B |
| Example 62 | B | A | A | A | B | A | B |
| Enample 63 | B | A | A | A | A | B | B |
| Example 64 | B | A | A | A | A | A | B |
| Example 65 | B | A | A | A | A | A | C |
| Example 66 | B | A | A | A | A | A | C |
| Example 67 | B | A | A | A | A | A | B |
| Example 68 | B | A | A | A | A | A | B |
| Comp. Example 9 | D | D | D | B | D | D | B |
| Comp. Example 10 | D | D | D | B | D | D | B |
| Comp. Example 11 | C | B | A | D | D | D | C |
| Comp. Example 12 | B | D | D | A | D | B | B |
| Comp. Example 13 | B | D | D | A | A | A | C |
| Comp. Example 14 | B | D | D | A | D | A | C |
| Comp. Example 15 | B | D | D | A | D | A | B |

The present invention can provide a thermal transfer recording image receiving layer and a method for the production thereof which are free from printing unevenness, high in sensitivity and transfer density, and immune from curling.

The object of the invention is to provide a thermal transfer recording image receiving sheet and a method for producing it, which are free from printing unevenness, high in sensitivity and transfer density, and immune from curling.

The invention comprises a thermal transfer recording image receiving sheet which has a support formed of a resin or a support bearing a first resin layer on its surface, a 5- to 100-μm thick laminating layer comprising polypropylene as principal component laminated, directly or via a first subbing layer, on said support formed of a resin or said first resin layer, and an image receiving layer having a dyeability to a thermo-diffusible dye and laminated on said laminating layer directly or via a second subbing layer; a thermal transfer recording image receiving sheet in which a second resin layer is laminated, directly or via a third subbing layer, on said support oppositely with the image receiving layer; a thermal transfer recording image receiving sheet which has a support composed of a base bearing a first resin layer on one side and a second resin layer on the other side, an intermediate layer having a porous structure laminated on said first resin layer of said support, and an image receiving sheet having a dyeability to a thermo-diffusible dye and laminated on said intermediate layer directly or via a barrier layer; and a method for producing a thermal transfer recording image receiving sheet which comprises the steps of forming a laminating layer by laminating a resin composition comprising polypropylene as principal component to a thickness of 5 to 100 μm by melt extrusion, directly or after providing a first subbing layer by coating and/or laminating, on a support formed of a resin or on a first resin layer of a support having said first resin layer on one side, and then laminating an image receiving layer having a dyeability to a thermo-diffusible dye on said laminating layer, directly or after providing a second subbing layer by coating and/or laminating; a method for producing a thermal transfer recording image receiving sheet in which said support is formed by providing a second resin layer through lamination of a resin, directly or via a third subbing layer, on the surface of said support oppositely with the side on which the image receiving layer is to be formed; and a method for producing a thermal transfer recording image receiving sheet in which an intermediate layer having a porous structure is formed on a third resin layer of a support composed of a base having said third resin layer on one side and a second resin layer on the other side, directly or after subjecting said third resin layer to a surface treatment, and then an image receiving layer having an dyeability to a thermo-diffusible dye is formed on the intermediate layer, directly or after providing a barrier layer.

What is claimed is:

1. A thermal transfer recording image receiving sheet comprising:

a resin support laminated with a polypropylene layer having a thickness of 5 to 100 μm, on the resin support via a first subbing layer and an image receiving layer coated on the polypropylene layer directly or via a second subbing layer; and the image receiving layer having a dyability to a thermo-diffusible dye.

2. The sheet of claim 1, wherein at least one of the first subbing layer and the second subbing layer contains at least one compound selected from the group consists of alkyltitanates, titanium-modified hydrophilic resin, ethylene and vinyl acetate copolymers, acrylic resins, urethane resins, polyester resins and epoxy resins.

3. The sheet of claim 2, wherein the polypropylene layer contains a white fine particle.

4. The sheet of claim 3, wherein the white fine particle is a hollow particle.

5. The sheet of claim 1, wherein a first resin layer is coated on the support on a side having the image receiving layer; and a second resin layer is coated on the support on an opposite side to the side having the image receiving layer, directly or via a third subbing layer.

6. The sheet of claim 5, wherein the resin support or the first resin layer contains polyethyleneterephthalate.

7. The sheet of claim 1 wherein the polypropylene layer has a thickness of 10 μm to 50 μm.

8. The sheet of claim 7 wherein the polypropylene layer is formed by melt extrusion.

9. The sheet of claim 7 wherein said polypropylene layer is formed of polypropylene having a density of 0.9 $g/cm^3$.

10. A thermal transfer recording image receiving sheet comprising:

a support laminated with a polypropylene layer having a thickness of 10 μm to 50 μm on the support via a first subbing layer; and an image receiving layer coated on the polypropylene layer directly or via a second subbing layer; and the image receiving layer having a dyability to a thermo-diffusible dye wherein the sheet has a first resin layer on one side and a second resin layer on an other side; and a porous intermediate layer is coated on the second resin layer and the image receiving layer coated on the porous intermediate layer directly or via a barrier layer.

11. The sheet of claim 10, wherein the porous intermediate layer contains a compound which was an insoluble liquid in a solvent at a temperature when the porous intermediate layer was coated onto the second layer.

12. The sheet of claim 10, wherein the support is a resin coated paper.

13. The sheet of claim 10, wherein at least one of the first resin layer and the second resin layer is polyolefine.

* * * * *